US009036858B1

(12) United States Patent
Reeves et al.

(10) Patent No.: US 9,036,858 B1
(45) Date of Patent: May 19, 2015

(54) CUSTOMIZABLE AUDIO SPEAKER ASSEMBLY

(71) Applicants: Brian Reeves, Mission Viejo, CA (US); Sean Nicholas, San Clemente, CA (US)

(72) Inventors: Brian Reeves, Mission Viejo, CA (US); Sean Nicholas, San Clemente, CA (US)

(73) Assignee: Audient, LLC, Santa Cruz, CA (US)

( * ) Notice: Subject to any disclaimer, the term of this patent is extended or adjusted under 35 U.S.C. 154(b) by 0 days.

(21) Appl. No.: 14/217,369

(22) Filed: Mar. 17, 2014

Related U.S. Application Data

(60) Provisional application No. 61/801,617, filed on Mar. 15, 2013.

(51) Int. Cl.
*H04R 1/02* (2006.01)

(52) U.S. Cl.
CPC ..... *H04R 1/021* (2013.01)

(58) Field of Classification Search
CPC ..... H04R 1/02; H04R 1/021; H04R 1/025; H04R 1/2811
USPC ..... 381/386, 387, 388, 394, 87, 332–334; D14/172, 204, 507, 509, 511; 181/153, 181/199
See application file for complete search history.

(56) References Cited

U.S. PATENT DOCUMENTS

| | | | | |
|---|---|---|---|---|
| 5,444,194 | A * | 8/1995 | Reinke | 181/150 |
| 2001/0042657 | A1* | 11/2001 | Yoshii et al. | 181/199 |
| 2008/0225510 | A1* | 9/2008 | Rocha | 362/86 |
| 2009/0067663 | A1* | 3/2009 | Ivey et al. | 381/386 |
| 2011/0299689 | A1* | 12/2011 | Avtzon et al. | 381/1 |

* cited by examiner

*Primary Examiner* — Tuan D Nguyen
(74) *Attorney, Agent, or Firm* — Karich & Associates; Eric Karich

(57) ABSTRACT

A customizable audio speaker assembly has a speaker housing enclosing electronic components of the speaker assembly, including a speaker for producing sound and a battery. A decorative cover is adapted to fit over an outer surface of the housing via first and second securing elements disposed on the speaker housing and the decorative cover, respectively. The decorative cover enables the quick and easy customization of the speaker assembly.

16 Claims, 4 Drawing Sheets

CUSTOMIZABLE AUDIO SPEAKER ASSEMBLY

CROSS-REFERENCE TO RELATED APPLICATIONS

This application for a utility patent claims the benefit of U.S. Provisional Application No. 61/801,617, filed Mar. 15, 2013.

STATEMENT REGARDING FEDERALLY SPONSORED RESEARCH

Not Applicable

BACKGROUND OF THE INVENTION

1. Field of the Invention

The present invention relates generally to speakers, and more particularly to a customizable audio speaker assembly.

2. Description of Related Art

Audio speakers come in a wide range of shapes and designs. Most speakers are made of components generally constructed to remain as a single piece when placed in a desired location. Some prior art speakers are adapted to be wirelessly connected with a portable electronic device (e.g., a cell phone) for playing music.

The prior art teaches external speakers that may be wirelessly connected with a portable electronic device. However, the prior art does not teach speakers that include an outer cover for providing interchangeable designs. The present invention fulfills these needs and provides further advantages as described in the following summary.

SUMMARY OF THE INVENTION

In one aspect, the present invention provides a customizable audio speaker assembly that includes a speaker housing enclosing electronic components of the speaker assembly, including a speaker for producing sound and a battery. A decorative cover is adapted to fit over an outer surface of the housing via first and second securing elements disposed on the speaker housing and the decorative cover, respectively. The decorative cover enables the quick and easy customization of the speaker assembly.

A primary objective of the present invention is to provide an audio speaker assembly having advantages not taught by the prior art.

Another objective is to provide an audio speaker assembly which can be customized to provide decorative features such as colors, graphics, text, images, and/or other decorative features selected by the user.

A further objective is to provide an audio speaker assembly which may be quickly and easily modified to even further alternative decorative configurations.

BRIEF DESCRIPTION OF THE DRAWINGS

The advantages and features of the present invention will become better understood with reference to the following more detailed description taken in conjunction with the accompanying drawings in which.

DETAILED DESCRIPTION OF THE DRAWINGS

Figure 1:
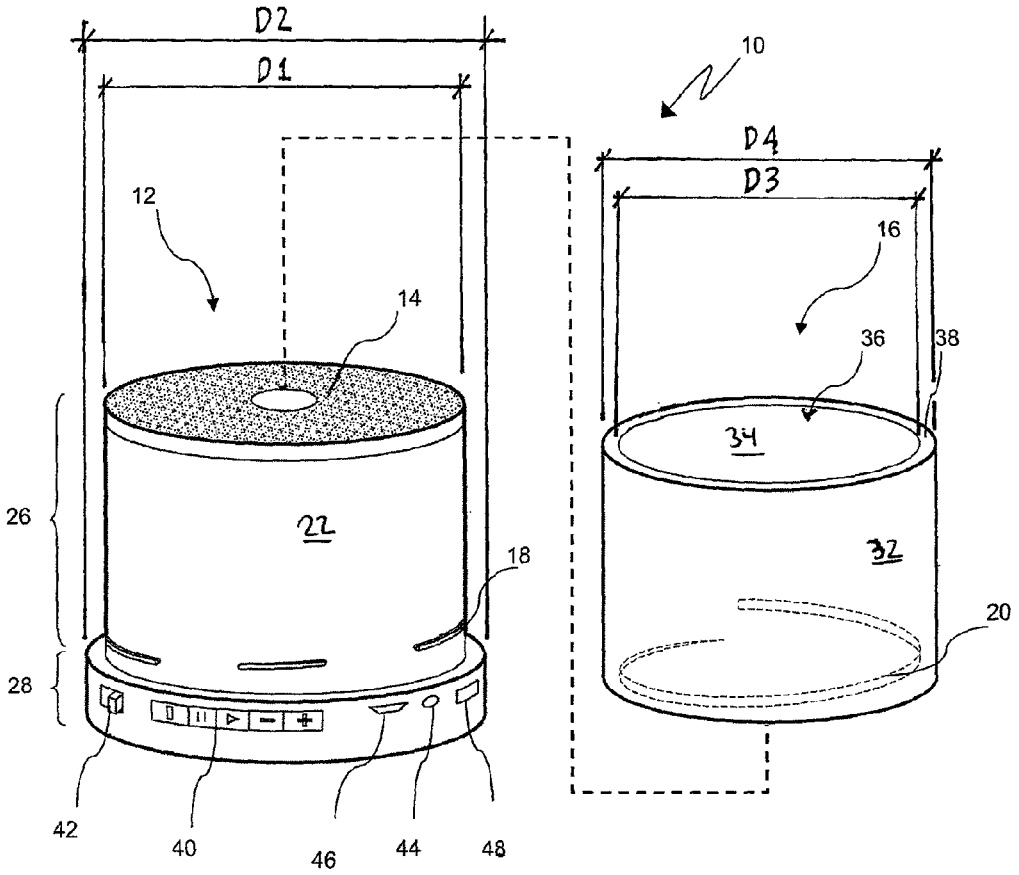
FIG. 1 is an exploded perspective view of a customizable audio speaker assembly, illustrating a speaker housing and a decorative cover according to one embodiment of the present invention.

FIG. 1 is an exploded perspective view of a customizable speaker assembly 10, illustrating a speaker housing 12 and a decorative cover 16 according to one embodiment of the present invention. The speaker housing 12 encloses electronic components of the speaker assembly 10, including a speaker 14 for producing sound, and other components discussed in greater detail below. As illustrated in FIG. 1, the decorative cover 16 fits on and/or over the speaker housing 12, and generally conforms to the shape and size of the speaker housing 12. A first securing element 18 and a second securing element 20 engage together to removably mount the decorative cover 16 on the speaker housing 12, as discussed in greater detail below.

As illustrated in FIG. 1, the housing 12 is for enclosing components of the speaker assembly 10 and may include an outer surface 22, an inner surface (not shown), an upper portion 26, and a lower portion 28. The speaker 14 may be disposed on the upper portion 26 to form a top surface of the speaker housing 12. The speaker 14 may be adapted to play a digital audio signal and may include any speaker device(s) (e.g., woofer, subwoofer, full-range, mid-range, tweeter, or any combination thereof).

In one embodiment, the speaker housing 12 is generally cylindrical in shape, though in other embodiments the housing 12 may be cuboid, or have any sort of cross-sectional shape that extends longitudinally to form the housing 12. The upper portion 26 and the lower portion 28 may be concentrically aligned along the length of the cylindrical speaker housing 12, and may have different diameters. The lower portion 28 may have diameter slightly more than the upper portion 26 and may form the base for the speaker assembly 10. The difference between the diameter of the upper portion 26 and the lower portion 28 may be such that it allows the decorative cover 16 to be mounted on the speaker housing 12 and cover the outer surface 22 up to the length of the upper portion 26 only. The decorative cover 16 rests on the intersection of the upper portion 26 and lower portion 28 of the speaker housing 12.

The speaker assembly 10 may rest on a surface in upright position with the lower portion 28 as the base and the speaker 14 facing upwards disposed on the top surface of the speaker housing 12. In one embodiment the speaker 14 may be circular in shape with diameter equal to the diameter of the upper portion 26 of the speaker housing 12. The length of the upper portion 26 may be significantly more than the lower portion 28.

The decorative cover 16 has a shape which may generally conform to the shape and size of the housing 12 and is adapted to fit on the outer surface 22 of the housing covering a portion of the housing 12, in this case the upper portion 26. The decorative cover 16 includes a decorative outer surface 32, an inner surface 34 and may include an opening 36 to allow the sound produced by the speaker 14 to freely pass through the decorative cover 16 when the decorative cover is mounted on the speaker housing 12. The decorated outer surface 32 may include decorative colors, pictures, text, symbols, and any other decorative elements (e.g., rhinestones, personalized elements, etc.). The decorated outer surface is discussed in greater detail in the description of FIG. 4.

In one embodiment of the speaker assembly 10, when the speaker housing 12 is in the shape of a cylinder, the decorative cover 16 is a hollow cylinder concentric with the speaker housing 12, having an inner diameter D3 equivalent to an outer diameter D2 of the top portion 26 of housing and height equal to the top portion 26 of the housing. The outside diameter D4 of the decorative cover 16 may be equivalent to the outside diameter D1 of the lower portion 28 of the speaker housing 12, such that when the decorative cover 16 is mounted on the speaker housing 12 the speaker assembly 10 appears to be single cylinder.

In the embodiment of FIG. 1, the decorative cover 16 may be open on top and bottom. The top of the decorative cover 16 may include a circular strip 38 concentric with the speaker housing 12 and extending radially inwards from the top edge of the decorative cover 16. The outer diameter D4 of the circular strip 38 may be equal to the outer diameter D4 of the decorative cover 16 and the inner diameter D3 may be equal to the outside diameter D1 of the circular speaker 14. The inner diameter D3 of the circular strip 38 also defines the opening 36. The decorative cover 16 may be made of plastic, metal or any suitable material which servers the purpose. In one embodiment the decorative cover 16 may be made of steel or similar metal, while in alternative embodiments, molded plastic or other suitable material may be used. While one embodiment of the decorative cover 16 is illustrated herein, those skilled in the art may devise many alternative structures that conforms to the shape and size of the speaker housing 12 to fit on the outer surface 22 of the housing, and such alternative structures should be considered within the scope of the present invention.

The first securing element 18 may be disposed on the outer surface 22 of the speaker housing 12 and the second securing element 20 may be disposed on the inner surface 34 of the decorative cover 16. The second securing element 20 is adapted to engage with the first securing element 18 to removably mount the decorative cover 16 on the housing 12. The two securing elements 18 and 20 are made corresponding to each other in shape and size such that the decorative cover 16 snugly fits over the housing 12 when the securing elements are engaged with each other.

In one embodiment of the present invention, the first securing element 18 and the second securing element 20 include threads, or structurally equivalent structures, for threadedly mounting the decorative cover 16 on the speaker housing 12. In this embodiment, the first securing element 18 is an external thread disposed on the outer surface 22 of the speaker housing 12. To engage with the external thread, the second securing element 20 may be an internal thread disposed on the inner surface 34 of the decorative cover 16. The shape, size and location of the first securing element 18 on the outer surface 22 of the speaker housing 12 and second securing element 20 on the inner surface 34 of the decorative cover 16, is such that both the securing elements 18 and 20 correspond to each other to be secured with each other. The securing engagement is such that it can be removed when required. The decorative cover 16 may be dismounted from the housing 12 by disengaging the securing elements.

In an alternative embodiment, the first securing element 18 and the second securing elements 18 and 20 may be any structural features that enables the elements to interact to form any form of twist lock mechanism, push down lock mechanism, frictional engagement, and/or a form of locking post or any suitable engaging elements. One of the securing elements 18 or 20 may also include a magnet or magnets, and the other of the securing elements 18 or 20 may be a metal portion, which may be part of the cover 16 itself. While a few embodiments of the first and second securing elements 18 and 20 are discussed herein, those skilled in the art may devise many alternative structures that function to mount the decorative cover 16 on the housing 12, and such alternative structures should be considered within the scope of the present invention.

Figure 2:
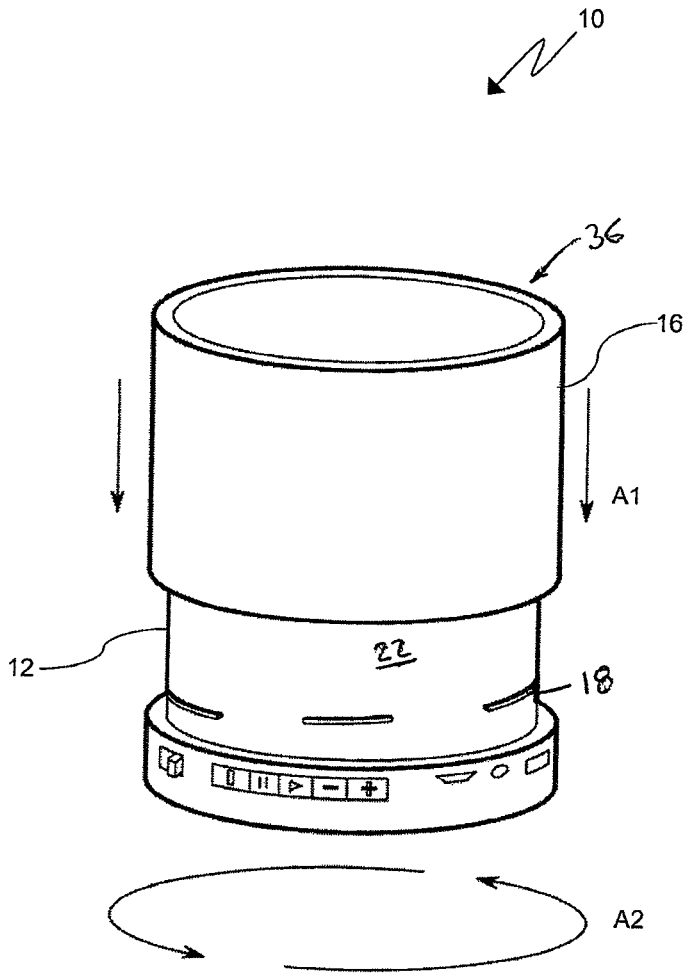
FIG. 2 is a perspective view thereof, illustrating the decorative cover being mounted on the speaker housing.

FIG. 2 is a perspective view of the customizable audio speaker assembly 10, illustrating the decorative cover 16 being mounted on the speaker housing 12. The decorative cover 16 is brought from top on the speaker housing 12 as indicated by the arrows A1. The decorative cover 16 is brought down till its lower end is near the lower portion 28 of the housing. Now the speaker housing 12 may be rotated as indicated by the arrows A2 relative to the decorative cover 16, engaging the first and second securing elements 18 and 20 with each other, thereby mounting the decorative cover 16 on the housing 12. The decorative cover 16 snugly fits on the speaker housing 12 covering the top portion 26 of the housing.

Figure 3:
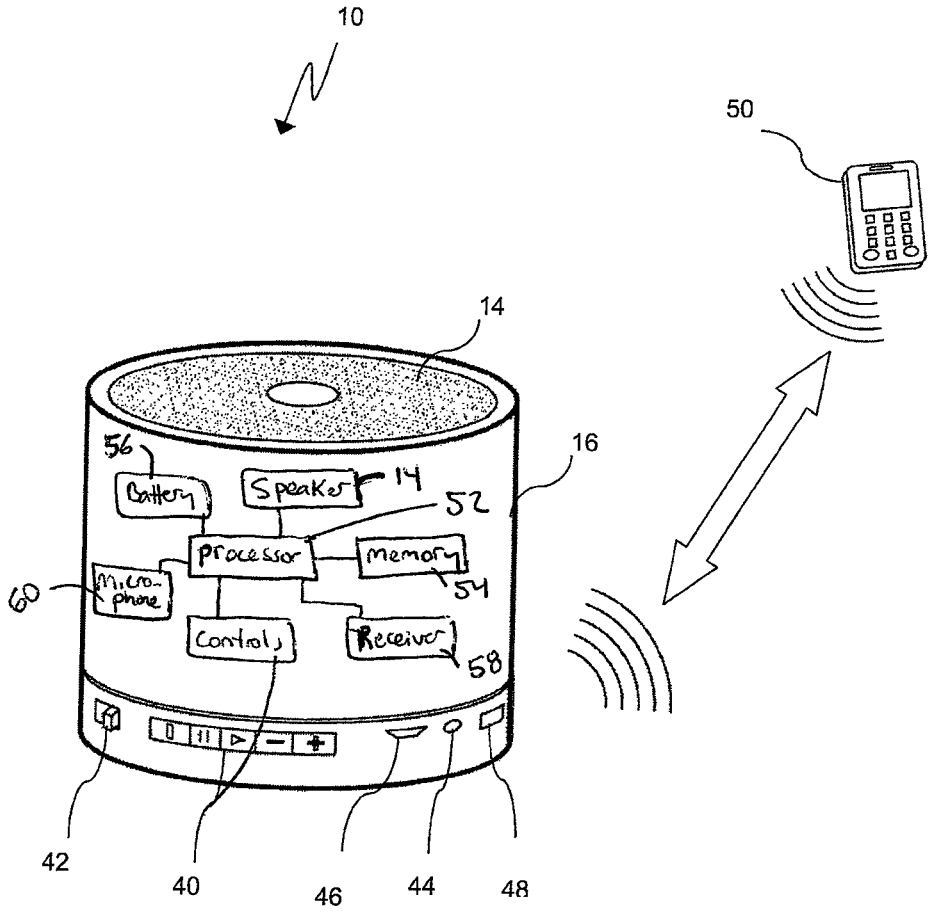
FIG. 3 is a perspective view of the customizable speaker assembly fully assembled, illustrating the customizable speaker assembly being used with a mobile phone, and further including a block diagram illustrating internal electronic components of the speaker assembly.

FIG. 3 is a perspective view of the customizable speaker assembly 10 fully assembled, illustrating the customizable speaker assembly 10 being used with a mobile phone 50, and further including a block diagram illustrating internal electronic components of the speaker assembly 10.

As illustrated in FIG. 3, the speaker housing 12 encloses the electronic components needed to play sound from the speaker 14. In one embodiment, this includes a processor 52 and a memory 54, which may include any form of processor, microprocessor, microcontroller, memory devices, etc., known in the art.

A battery 56 supplies the needed power to the speaker assembly 10. When the battery 56 is discharged, it may be replaced with another battery or it may be charged by connecting to an external power supply via a power socket 44.

In the embodiment of FIG. 3, the speaker assembly 10 may further include controls 40 such as a set of control buttons (e.g., disposed on the lower portion 28 of the speaker housing 12) to operate the audio speaker assembly 10. These buttons may include a play, pause, reverse, fast forward, volume up and volume down buttons, and/or any other similar controls known in the art.

In the embodiment of FIG. 3, the speaker assembly 10 may further include an ON/OFF switch 42, and a data socket 46 to receive the digital audio file from an external device. The ON/OFF switch 42 is used to turn the speaker 14 ON/OFF when needed. The power socket 44 (and/or the data socket 46) allows charging the battery 56, and/or to directly power the speaker assembly 10.

In one embodiment of the present invention, the speaker assembly 10 may be include a receiver 58 to receive a wireless digital signal (e.g. Bluetooth®, Wi-Fi, or equivalent). In another embodiment, the speaker housing 12 includes a memory chip slot 48 for receiving a memory chip (not shown) which includes digital audio files which may then be played. The memory chip slot 48 may be used to connect with an SD card (or other form of memory device).

In one embodiment of the present invention, the audio speaker assembly 10 may further include a microphone 60 for using the assembly 10 to conduct conference calls in conjunction with the mobile phone 50. The mobile phone 50 may be connected via to the speaker assembly 10 using the Bluetooth® receiver 58 to take a call.

Figure 4:
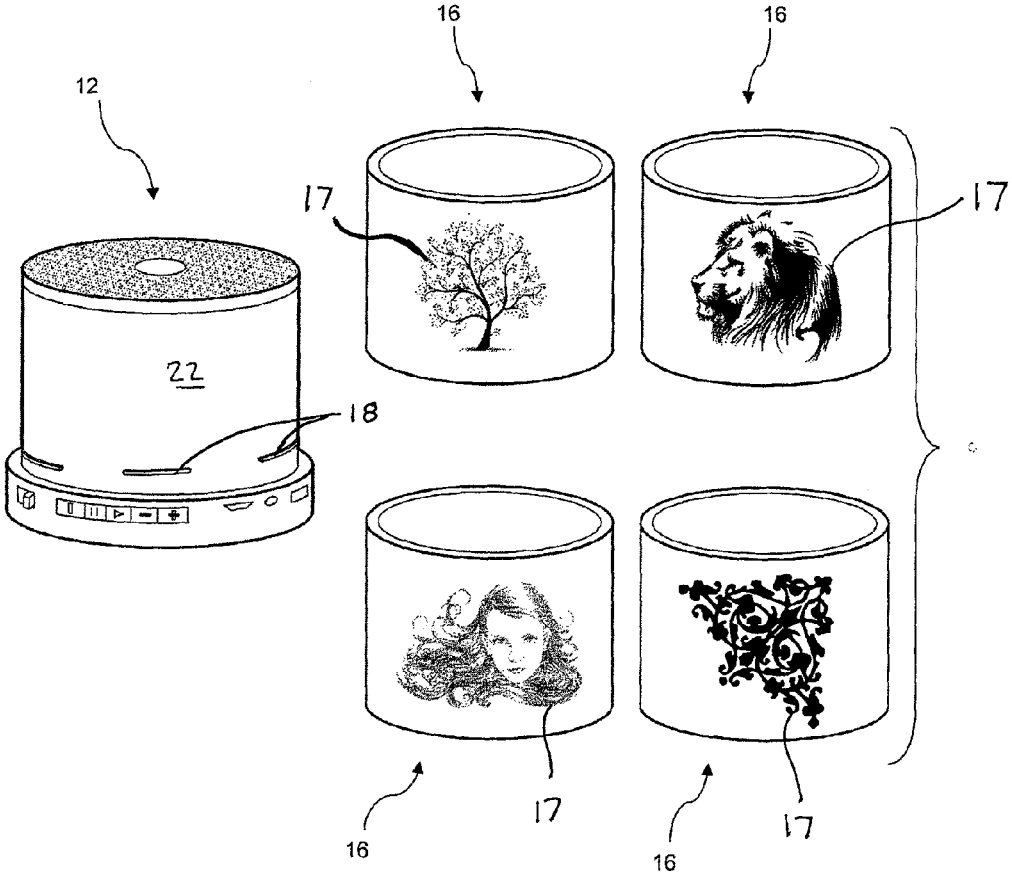
FIG. 4 is a perspective view of the speaker housing and four exemplary decorative covers each decorated with a unique image.

FIG. 4 is an exploded perspective view of the speaker housing 12 and four exemplary decorative covers 16 each decorated with a picture. The decorated outer surface 32 of the decorative cover 16 may be decorated with different pictures or have a variety of decorative features 17 distributed upon the decorated outer surface 32, as shown. The decorated outer surface 32 may also be used to print a logo or trademark of a company. The decorated outer surface 32 may also include a layer of thin film with a picture applied on the decorated outer surface 32. The means of attaching the decorative features 17 to the decorated outer surface 32 may be any known to one skilled in the art, such as gluing, laminating, printing, engraving, welding, clasping, etc., with such means and variations thereof being equivalent and within the scope of the invention.

Although a particular exemplary embodiment of the invention has been disclosed in detail for illustrative purposes, it will be recognized to those skilled in the art that variations or modifications of the disclosed invention, including the rearrangement in the configurations of the parts, changes in sizes and dimensions, variances in terms of shape may be possible.

Accordingly, the invention is intended to embrace all such alternatives, modifications and variations as may fall within the spirit and scope of the present invention.

The exemplary embodiments described herein detail for illustrative purposes are subject to many variations of structure and design. It should be emphasized, however that the present invention is not limited to particular decorative speaker assembly as shown and described. Rather, the principles of the present invention can be used with a variety of configurations and arrangements of decorative speaker assemblies. It is understood that various omissions, substitutions of equivalents are contemplated as circumstances may suggest or render expedient, but the present invention is intended to cover the application or implementation without departing from the spirit or scope of the claims.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. The terms 'decorative speaker' or 'decorative audio speaker' or 'decorative audio speaker assembly' or 'decorative speaker assembly' or 'speaker assembly' may have been used above interchangeably and refer to convey the same meaning. Furthermore, the terminology used in the specification provided above is hereby defined to include similar and/or equivalent terms, and/or alternative embodiments that would be considered obvious to one skilled in the art given the teachings of the present patent application.

What is claimed is:

1. A customizable audio speaker assembly comprising:

a speaker housing that contains speaker electronic components;

an outer surface of the speaker housing that includes an undecorated surface that forms a substantial part of the speaker housing;

a first securing element disposed on the undecorated surface;

a decorative cover shaped and sized to fit over the undecorated surface, the decorative cover having a decorative outer surface and an opposed inner surface; and a second securing element disposed on the inner surface of the first decorative cover, such that the decorative cover may be removably mounted on the housing to cover the undecorated surface.

2. The customizable audio speaker of claim 1, wherein the outer surface of the speaker housing is cylindrical and the decorative cover is also cylindrical.

3. The customizable audio speaker of claim 1, wherein the speaker housing is made of plastic and the decorative cover is made of metal.

4. The customizable audio speaker of claim 1, wherein decorative features are distributed upon the decorative outer surface.

5. A customizable audio speaker assembly comprising:

a speaker housing enclosing components of the speaker assembly, the speaker housing including an outer surface, an inner surface, an upper portion, a lower portion and a top surface;

a speaker device for producing sound, the speaker being disposed on or within the speaker housing and adapted to play a digital audio signal;

a battery to power the speaker device;

a decorative cover conforming to the shape and size of the speaker housing and adapted to fit on the outer surface of the housing covering a portion of the speaker housing, the decorative cover including a decorated outer surface and an inner surface;

a first securing element disposed on the outer surface of the speaker housing; and a second securing element disposed on the inner surface of the decorative cover, such that the second securing element is adapted to engage with the first securing element to removably mount the decorative cover on the speaker housing, whereby the decorative cover may be selected and added and/or removed to customize the appearance of the customizable audio speaker assembly.

6. The customizable audio speaker assembly according to claim 5, wherein the first securing element and the second securing element include an external and an internal thread, respectively.

7. The customizable audio speaker assembly of claim 5, wherein the decorative cover includes an opening for allowing sound out.

8. The audio speaker assembly according to claim 5, further includes a set of control buttons disposed on a lower portion of the speaker housing to operate the audio speaker assembly.

9. The audio speaker assembly according to claim 5, further includes an ON/OFF switch, a power socket to receive line in power supply, a data socket to play the digital audio file from an external device by using a data cable.

10. The audio speaker assembly according to claim 5, further includes a memory chip slot to play the digital audio file from an external memory device.

11. The audio speaker assembly according to claim 5, further includes a wireless receiver to wirelessly connect with an external wireless enabled audio device and wirelessly play the digital audio file stored on the external wireless enabled audio device.

12. The audio speaker assembly according to claim 5, further includes a microphone and a Bluetooth receiver to wirelessly connect with a Bluetooth enabled mobile phone and make conversation on the mobile phone using the audio speaker assembly.

13. The audio speaker assembly according to claim 5, wherein the speaker housing is cylindrical in shape.

14. The audio speaker assembly according to claim 5, wherein the decorative cover is a hollow cylinder concentric with the housing, having a diameter more than the housing diameter and height equal to the top portion of the housing, the decorative cover being open on top and bottom sides, the top side including a circular strip concentric with the housing and extending radially inwards from a top edge of the decorative cover.

15. A decorative audio speaker assembly comprising:

a housing of a cylindrical shape enclosing components of the speaker assembly, the housing including an outer surface, an inner surface, an upper portion, a lower portion and a top surface;

a speaker for producing sound, the speaker being disposed on the top surface of the housing and adapted to play a digital audio file;

a rechargeable battery to power the decorative audio speaker assembly;

a decorative cover in a shape of a hollow cylinder open on top and bottom sides concentric with the housing, having a diameter more than the housing diameter and height equal to the top portion of the housing, wherein the decorative cover including a decorated outer surface, an inner surface, an opening to allow the sound produced by the speaker to freely pass through the decorative cover, the top side including a circular strip concentric with the housing and extending radially inwards from a top edge of the decorative cover;

an external thread disposed on the outer surface of the housing; and an internal thread disposed on the inner surface of the decorative cover, such that the internal thread is adapted to engage with the external thread to removably mount the decorative cover on the housing.

16. A decorative audio speaker assembly comprising:

a housing of a cylindrical shape enclosing components of the speaker assembly, the housing including an outer surface, an inner surface, an upper portion, a lower portion and a top surface;

a speaker for producing sound, the speaker being disposed on the top surface of the housing and adapted to play a digital audio file;

a rechargeable battery to power the decorative audio speaker assembly;

a decorative cover in a shape of a hollow cylinder open on top and bottom sides concentric with the housing, having a diameter more than the housing diameter and height equal to the top portion of the housing, wherein the decorative cover including a decorated outer surface, an inner surface, an opening to allow the sound produced by the speaker to freely pass through the decorative cover being, the top side including a circular strip concentric with the housing and extending radially inwards from a top edge of the decorative cover;

an external thread disposed on the outer surface of the housing;

an internal thread disposed on the inner surface of the decorative cover, such that the internal thread is adapted to engage with the external thread to removably mount the decorative cover on the housing;

a set of control buttons disposed on the lower portion of the housing to operate the audio speaker;

a power socket to receive line in power supply;

an ON/OFF switch;

a data socket to play the digital audio file from an external device by using a data cable;

a memory chip slot to play the digital audio file from an external memory device; and a wireless receiver to wirelessly connect with an external wireless enabled audio device and wirelessly play the digital audio file stored on the external wireless enabled audio device.

* * * * *